US006776674B2

(12) United States Patent
Blanchard

(10) Patent No.: US 6,776,674 B2
(45) Date of Patent: Aug. 17, 2004

(54) AXIAL-FLOW OUTBOARD JET PROPULSION UNIT

(75) Inventor: Clarence E. Blanchard, Pleasant Prairie, WI (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 09/927,719

(22) Filed: Aug. 11, 2001

(65) Prior Publication Data

US 2003/0032344 A1 Feb. 13, 2003

(51) Int. Cl.[7] ..... B63H 11/00
(52) U.S. Cl. ..... 440/38; 248/640
(58) Field of Search ..... 248/640–643; 440/38–42, 89, 53; 123/195 P

(56) References Cited

U.S. PATENT DOCUMENTS

| | | | | | |
|---|---|---|---|---|---|
| 1,733,361 | A | * | 10/1929 | Rice, Jr. | 440/55 |
| 1,844,386 | A | * | 2/1932 | Harris et al. | 440/88 |
| 1,857,636 | A | * | 5/1932 | Heide | 440/60 |
| 2,676,559 | A | * | 4/1954 | Davies | 440/53 |
| 3,082,732 | A | | 3/1963 | Stallman | |
| 3,105,353 | A | | 10/1963 | Schultz | |
| 3,128,740 | A | | 4/1964 | Burgin | |
| 3,842,787 | A | | 10/1974 | Giacosa | |
| 3,889,623 | A | | 6/1975 | Arnold | |
| 4,437,841 | A | | 3/1984 | Stallman | |
| 4,538,996 | A | * | 9/1985 | Inwood | 440/38 |
| 5,273,467 | A | * | 12/1993 | Hall | 440/89 |
| 5,325,662 | A | * | 7/1994 | Varney et al. | 440/89 |
| 5,482,482 | A | * | 1/1996 | Davis | 440/67 |
| 5,938,490 | A | * | 8/1999 | Rodler | 440/41 |
| 5,964,626 | A | * | 10/1999 | Varney et al. | 440/38 |
| 6,168,485 | B1 | * | 1/2001 | Hall et al. | 440/89 |
| 6,283,805 | B1 | * | 9/2001 | Ishigaki | 440/38 |

FOREIGN PATENT DOCUMENTS

| | | |
|---|---|---|
| GB | 902049 | 7/1962 |

* cited by examiner

*Primary Examiner*—Andrew Wright
(74) *Attorney, Agent, or Firm*—BRP Legal Services

(57) ABSTRACT

An axial-flow outboard water jet propulsion unit is designed so that it does not extend below the bottom of the boat hull, but rather is disposed directly behind the hull transom. This is achieved by arranging the impeller shaft generally perpendicular to a generally vertical drive shaft, and by installing the impeller in a flow-through duct which, although placed directly behind the transom, has an inlet for taking in water located directly below the impeller shaft. The duct does not extend to a depth lower than the lowest point of the hull bottom. The impeller shaft penetrates the duct wall, while the impeller itself is rotatable inside the duct. The impeller impels water rearward toward a convergent exit nozzle of the duct, sucking in water through the duct intake. The aft opening of the exit nozzle forms the duct discharge outlet.

15 Claims, 4 Drawing Sheets

AXIAL-FLOW OUTBOARD JET PROPULSION UNIT

FIELD OF THE INVENTION

This invention generally relates to water jet propulsion systems for propelling boats or other watercraft. In particular, the invention relates to outboard water jet propulsion units comprising an engine and a ducted impeller driven by the engine.

BACKGROUND OF THE INVENTION

Jet-powered boats can be categorized in part in accordance with the types of propulsion systems used. The powerhead can be mounted either inside the hull or outside the hull. In the latter case, the powerhead is mounted on the transom portion of the boat hull and is detachable. Another type of system, called stern drive system, and sometimes referred to as an inboard-outboard system, utilizes a powerhead mounted inside the hull of the boat with a portion of the drive unit extending through the transom. These systems create thrust through rotation of a ducted impeller, which draws water from ahead and impels the water rearward to propel the boat forward.

To facilitate use of water jet-propelled boats in shallow water, it is known to mount the ducted impeller at an elevation such that the propulsion system does not project below the bottom of the boat hull. This can be accomplished, for example, by installing a duct in the stern of the boat, the duct being arranged to connect one or more inlet holes formed in the bottom of the hull with an outlet hole formed in the transom. The water jet is then installed outside the hull in a position such that the water jet inlet is in fluid communication with the duct outlet at the transom. Alternatively, a water tunnel is formed in the bottom of the hull which is open at the bottom and at the transom. A water jet propulsion system is then mounted to the transom by means of a mounting adapter, the inlet of the propulsion system being in fluid communication with the water tunnel via the adapter.

The use of outboard water jet propulsion units is not new to the marine industry. However, the majority of these applications utilize a centrifugal pump, which allows the propulsion unit to be designed so that it does not extend below the hull bottom. An axial-flow pump is disclosed in U.S. Pat. No. 3,842,787. However, the inlet duct of that system extends below the hull bottom.

There is a need for an axial-flow outboard water jet propulsion unit which does not extend below the hull bottom.

As used herein, the term "axial-flow pump" means a ducted impeller in which the water is impelled in a direction generally parallel to the axis of impeller rotation. This is in contrast to a centrifugal pump, in which water is impelled radially outward in directions perpendicular to the axis of impeller rotation.

SUMMARY OF THE INVENTION

The present invention is directed to an outboard water jet propulsion unit comprising an axial-flow pump. Preferably the water jet propulsion unit is designed so that it does not extend below the bottom of the boat hull, but rather is disposed directly behind the hull transom. This is achieved by arranging the impeller shaft generally perpendicular to a generally vertical drive shaft, and by installing the impeller in a flow-through duct which, although placed directly behind the transom, has an inlet for taking in water located directly below the impeller shaft. In the preferred embodiment of the invention, the duct does not extend to a depth lower than the lowest point of the hull bottom. The impeller shaft penetrates the duct wall, while the impeller itself is rotatable inside the duct. The impeller impels water rearward toward a convergent exit nozzle of the duct, sucking in water through the duct intake. The aft opening of the exit nozzle forms the duct discharge outlet.

In accordance with the preferred embodiment of the invention, the propulsion unit comprises: an engine support housing; an engine supported by the engine support housing; a drive shaft having one end coupled to the engine; an inlet housing attached to and located beneath the engine support housing; and an outlet housing attached to the rear of the inlet housing. The inlet housing comprises a flow-through passage having an inlet and an outlet. The outlet housing comprises a flow-through passage in fluid communication with the inlet housing passage. Preferably, the outlet housing passages converges toward an outlet. The inlet and outlet housings form a duct. In addition, the propulsion unit may comprises: an impeller shaft which penetrates a wall of the inlet housing; an impeller mounted to the impeller shaft and rotatable within the inlet housing passage; bearings for rotatably supporting the shafts; and gears for converting rotation of the drive shaft into rotation of the impeller shaft. The impeller shaft is generally perpendicular to the drive shaft, and the inlet of the inlet housing lies underneath the impeller shaft.

In accordance with a further feature of the preferred embodiment, the engine support housing, the inlet housing and the outlet housing each comprise a respective exhaust gas passage. These exhaust gas passages are connected in series so that exhaust gas from the engine is discharged below the waterline.

In accordance with another feature of the preferred embodiment, the gears are housed in a gear housing which is integrally formed with the inlet housing.

In addition, a steering nozzle is pivotably mounted to the exit nozzle. The steering nozzle is pivotable about an axis which is generally perpendicular to the impeller shaft. Because the boat can be steered by turning the steering nozzle, the outboard water jet propulsion unit does not need to be pivotable about a vertical axis, thereby simplifying the mounting of the outboard propulsion unit to the boat hull.

DETAILED DESCRIPTION OF THE PREFERRED EMBODIMENTS

Figure 1:
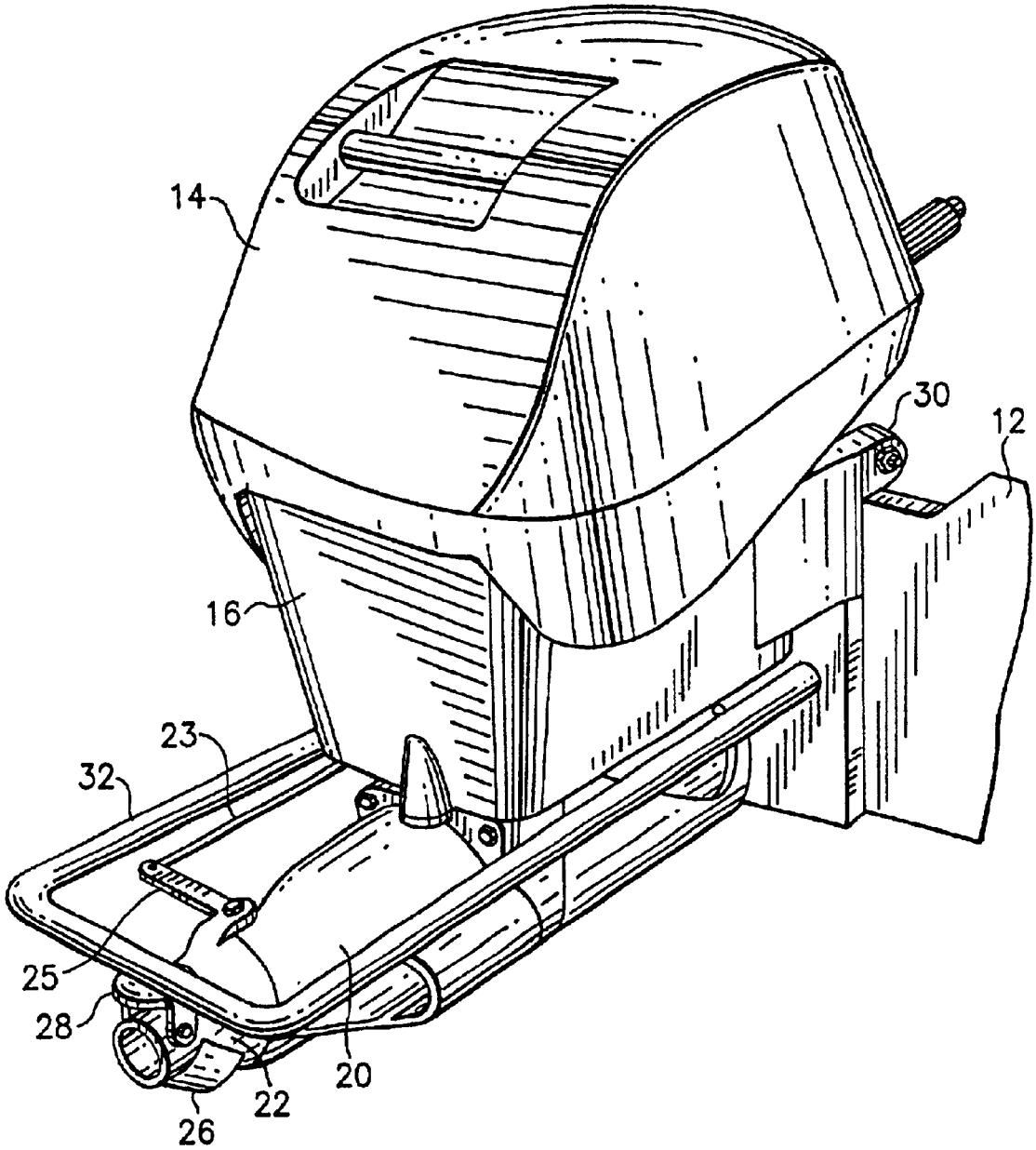
FIG. 1 is a schematic showing an isometric view of an outboard water jet propulsion unit in accordance with the preferred embodiment of the invention.

An outboard water jet propulsion unit 10, in accordance with the preferred embodiment of the invention, is shown in FIG. 1, mounted to a hull transom 12. As will be explained in more detail below with reference to exploded and sectional views of the system, the engine (not visible behind motor cover 14 in FIG. 1) is mounted on and supported by an exhaust housing 16, while the inlet/gear housing 18 is located below and supported by the exhaust housing 16. The exhaust housing comprises a pair of support arms 30, by means of which the exhaust housing (and the entire unit) can be hung on the top edge of the hull transom 12. The water intake is located at the bottom of the inlet/gear housing 18 and is not visible in FIG. 1. An outlet housing 20 is attached to the rear face of the inlet housing. Preferably the outlet housing comprises a convergent exit nozzle for increasing the pressure of the water discharge.

A steering nozzle 22 is pivotably mounted to the exit nozzle by means of a pair of pivot pins 24 (only one of which is visible in FIG. 1) which are coaxial with a vertical axis. This allows the steering nozzle to be pivoted from side to side for directing thrust to one side or the other for the purpose of steering the boat. The water exiting the steering nozzle creates a reaction force which propels the boat forward. The angular position of steering nozzle 22 is controlled by a steering rod 23, which is pivotably coupled to a clevis at the end of a lateral steering arm 25. The water flow exiting the steering nozzle 22 can be reversed by activation of a conventional reverse gate 28, which is actuated by a shift rod not shown. The reverse gate 28 blocks the rearward discharge of water from the steering nozzle outlet and redirects it througth a slot and out a flow-reversing passage 26 with a forward (instead of rearward) velocity component. The steering nozzle 22, steering arm 25 and flow-reversing passage 26 are preferably formed as one cast metal piece. The levers, rods and tables for actuating the shift and steering rods from a remote location, e.g., the cockpit of the boat, although not shown in FIG. 1, are conventional structures which penetrate the hull transom in well-known manner.

Optionally, a rigid U-shaped bar 32 can be fixedly installed to serve as a bumper for preventing objects from impacting or colliding with the steering nozzle and reverse gate.

Figure 2:
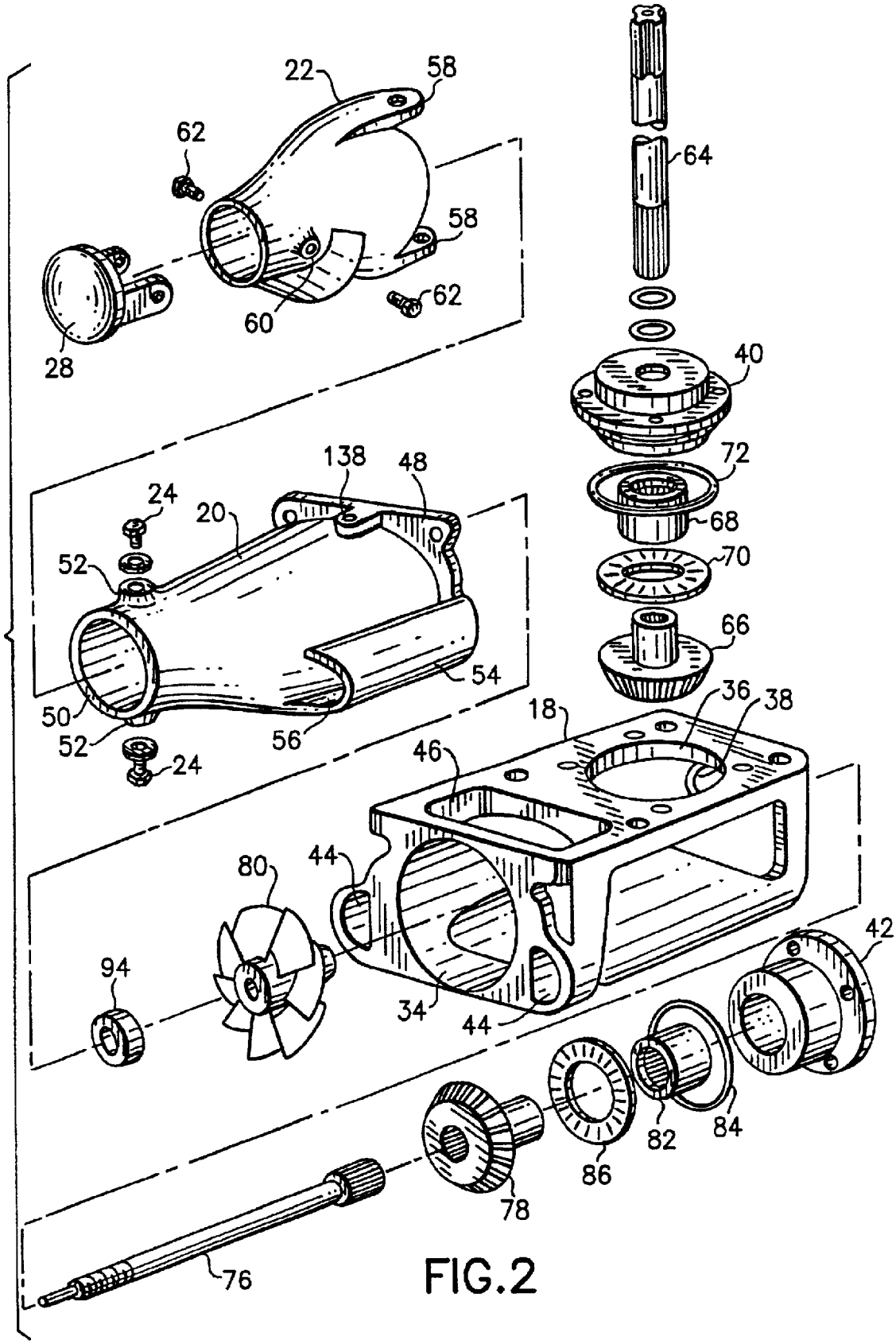
FIG. 2 is a schematic showing an exploded view of a jet pump unit incorporated in the outboard water jet propulsion unit shown in FIG. 1.

The disassembled axial-flow pump unit is shown in FIG. 2. The inlet/gear housing 18 comprises a chamber for housing the gear and bearing assemblies, as well as a water tunnel having an inlet (not visible in FIG. 2) formed in the bottom of the housing and an outlet 34 formed in the rear face of the housing. The inlet/gear housing 18 is further provided with an opening 36 in its top face and an opening 38 in its forward face for respectively receiving a bearing head 40 of a vertical drive shaft assembly and a bearing head 42 of a horizontal impeller shaft assembly. In addition, the inlet/gear housing 18 comprises a pair of exhaust gas outlets 44, formed in the rear face, which communicate with an exhaust gas inlet 46, formed in the top face. The top face of the inlet/gear housing 18 further comprises a plurality of throughholes for receiving a corresponding plurality of fasteners for attaching the inlet/gear housing to the exhaust housing (not shown in FIG. 2).

The outlet housing 20 comprises a mounting flange 48 with throughholes for receiving fasteners for attaching the outlet housing to the rear face of the inlet/gear housing. The outlet housing converges in the rearward direction to form an exit nozzle having a discharge outlet 50. A pair of bosses 52 are integrally formed on the outside of the exit nozzle to provide reinforcement around the holes which respectively receive the steering pivot pins 24. Also, a pair of exhaust gas passages 54 (only one of which is visible in FIG. 2) are integrally formed as parts of the outlet housing 20. Each exhaust gas passage 54 has an inlet connected to a respective exhaust gas outlet 44 of the inlet/gear housing 18, and an outlet 56 (only one of which is visible in FIG. 2).

As shown in FIG. 2, the steering nozzle 22 comprises a pair of pivot arms 58 which have apertures for penetration by the pivot pins 24 and a lateral steering arm (shown in FIG. 1 only). The steering nozzle can be pivoted about the axis of pins 24 (by pulling and pushing on the lateral steering arm) to produce lateral steering thrust. A pair of bosses 60 are formed on the sides of the exterior of the steering nozzle 22. The bosses 60 provide reinforcement for threaded holes which respectively receive a pair of reverse pivot pins 62. The reverse pivot pins 62 are coaxial with a horizontal axis. The reverse gate is pivotable up and down about the reverse pivot pins 62.

Figure 4:
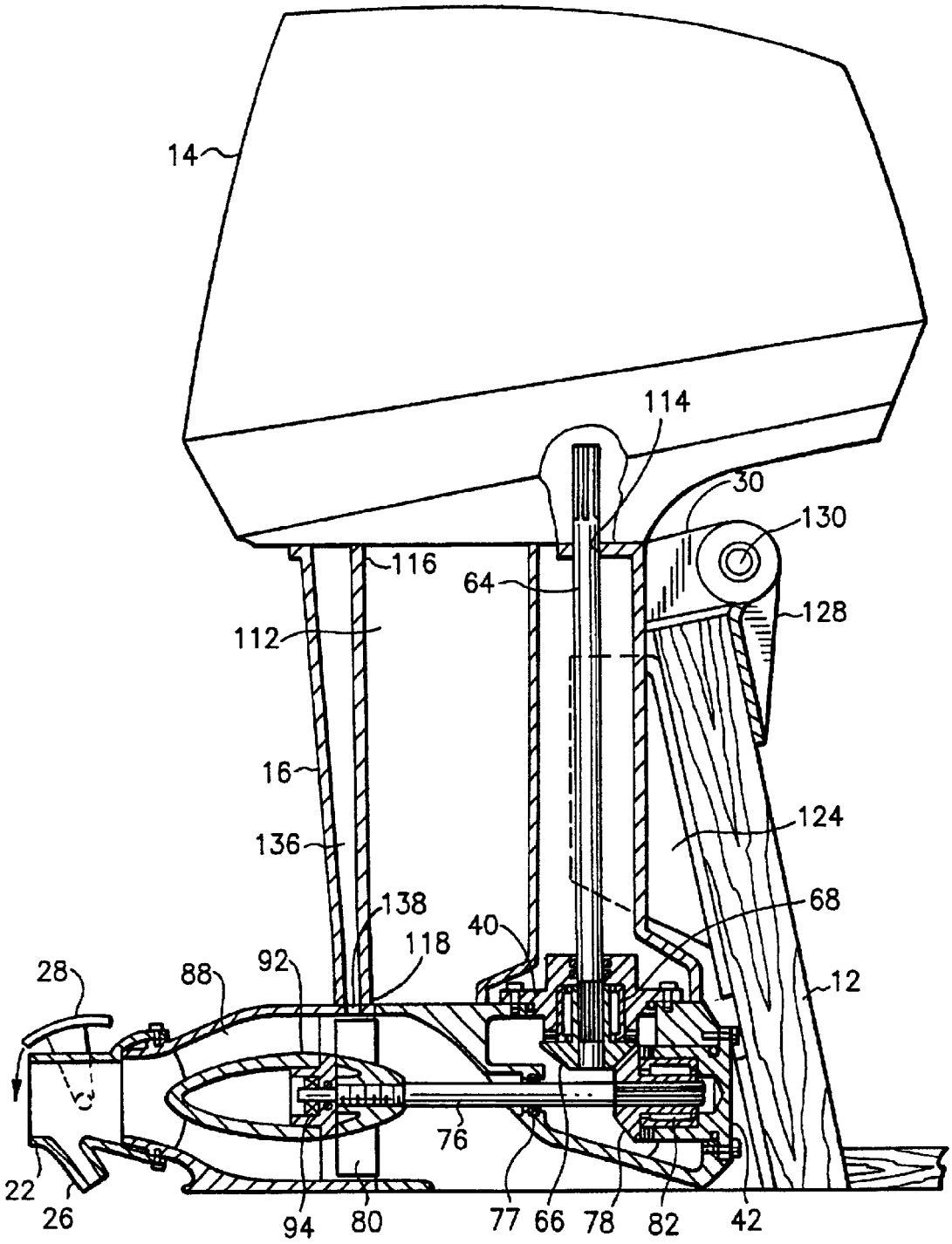
FIG. 4 is a schematic showing a partially sectioned view of the outboard water jet propulsion unit in accordance with the preferred embodiment of the invention.

The components for the vertical drive shaft assembly and the horizontal impeller shaft assembly are also shown in FIG. 2. The drive and impeller shaft assemblies (assembled using the components depicted in FIG. 2) are shown in FIG. 4. The following description of the drive and impeller shaft assemblies should be read with reference to both FIGS. 2 and 4.

In accordance with the preferred embodiment of the invention, the vertical drive shaft assembly comprises a generally vertical drive shaft 64 having one end coupled to the output shaft of the engine (not shown) and the other end having a pinion gear 66 coupled thereto. For example, a splined end of the drive shaft 64 may be inserted in a splined recess formed in the pinion gear 66. The pinion gear 66 is rotatably supported by bearing 68 which is held in bearing head 40. A thrust bearing 70 is installed between the pinion gear 66 and the bearing head 40. The bearing head 40 is bolted to the top face of the inlet/gear housing 18 and has a small-diameter portion which sits in the opening 36. The interface of the small-diameter portion of the bearing head 40 and the edge of the opening 36 is sealed by an O-ring 72. A pair of lip seals 74 are placed between the drive shaft 64 and the bearing head 40.

Again referring to both FIGS. 2 and 4, the horizontal impeller shaft assembly comprises a generally horizontal impeller shaft 76 having a bevel gear 78 coupled to one end and an impeller 80 coupled near the other end. The hub and blades of the impeller 80 are integrally formed as one cast piece. The impeller 80 rotates in unison with the impeller shaft 76. The outer surface of the impeller hub forms the radially inner boundary for guiding the flow of water impelled by the impeller. The impeller 80 may be screwed onto a threaded portion of the impeller shaft 76, while a splined end of the impeller shaft 76 is inserted in a splined recess formed in the bevel gear 78. The chamber for the gear and bearing assemblies and the water tunnel of the inlet/gear housing 18 share a common interior wall 41 which is penetrated by the impeller shaft 76. The impeller shaft penetration is sealed by a seal 77.

The bevel gear 78 is rotatably supported by bearing 82 which is held in bearing head 42. A thrust bearing 86 is installed between the bevel gear 78 and the bearing head 42. The bearing head 42 is bolted to the front face of the inlet/gear housing 18 and has a small-diameter portion which sits in the opening 38. The interface of the small-diameter portion of the bearing head 42 and the edge of the opening 38 is sealed by an O-ring 84.

As seen in FIG. 4, typically the outlet housing 48 comprises a plurality of stator vanes 88 extending radially from a stator hub 90 to the outer shell of the housing. The stator hub 90 comprises a bearing housing 92 which houses a sealed bearing 94 for rotatably supporting the end of the impeller shaft 76. The stator vanes 88 are designed to redirect the swirling flow out of the impeller 80 into non-swirling flow. The straightened flow exits the outlet housing 48 via a convergent thrust nozzle, which increases the water pressure.

As seen in FIG. 4, the beveled teeth of bevel gear 66 intermesh with the beveled teeth of bevel gear 78, thereby coupling the impeller shaft 76 to the drive shaft 64. This beveled tooth coupling converts the rotation about the axis of the drive shaft into rotation about the axis of the impeller shaft. These axes are preferably generally vertical and generally horizontal respectively so that the water discharge is directed generally horizontally. However, a person skilled in the art will readily appreciate that if, for design reasons, the axis of the impeller shaft deviates from true horizontal, the steering nozzle can be designed to compensate for that by fabricating the water passage of the steering nozzle such that its centerline deviates from perpendicularity with the pivot axis (and deviates from parallelism with the impeller shaft axis) by the same angle of deviation. In that case the centerline axis of the steering nozzle will be horizontal even though the impeller shaft axis is not, ensuring that the water is discharged in a horizontal direction.

Figure 3:
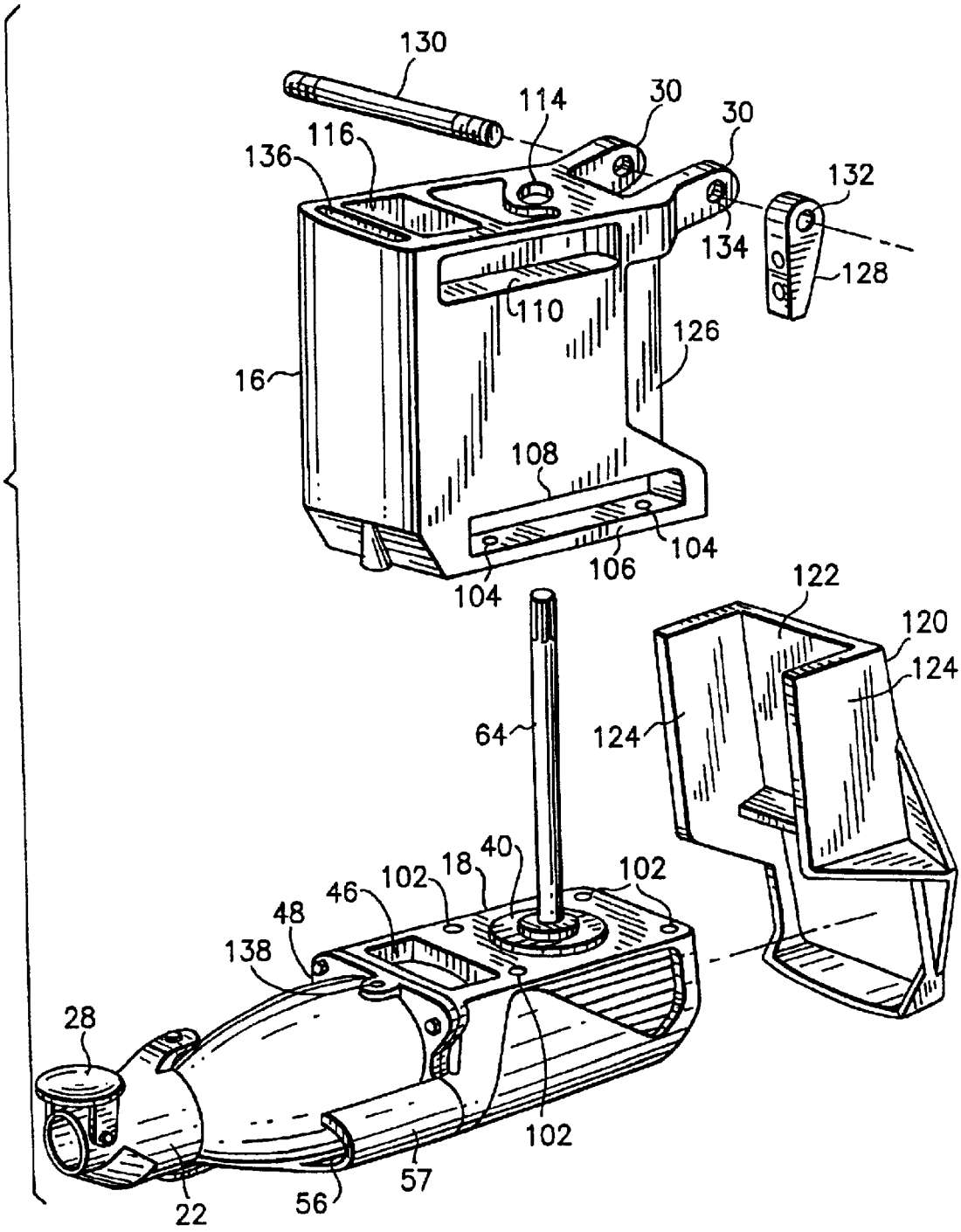
FIG. 3 is a schematic showing an exploded view of the outboard water jet propulsion unit shown in FIG. 1, with the axial-flow jet pump unit assembled.

The separate components shown in FIG. 2 are assembled into the pump unit generally designated with the numeral 100 in FIG. 3. The assembled pump unit 100 is in turn attached to the exhaust housing 16 by fasteners (not shown). The exhaust housing 16 has a vertical passage for the vertical drive shaft 64, the top of which penetrates an opening 114 in the top face of the exhaust housing. To attach the assembled pump unit 100 to the exhaust housing 16, vertical drive shaft 64 must be aligned with the opening 114 and then lowered onto the pump unit until the bottom face of the exhaust housing sits on top of the top face of the inlet/gear housing 18. As seen in FIG. 3, the top face of the inlet/gear housing has four threaded bores 102 which align with corresponding bores 104 in opposing recessed side flanges 106 of the exhaust housing 16. A pair of recesses 108 formed near the bottom on opposing sides of the exhaust housing (only one of which is visible in FIG. 3) provide clearance for insertion and torquing of bolts (not shown) for attaching the assembled pump unit 100 to the exhaust housing 16. Similarly, a pair of recesses 110 formed near the top on opposing sides of the exhaust housing (only one of which is visible in FIG. 3) provide clearance for insertion and torquing of bolts (not shown) for attaching the engine (not shown) to the exhaust housing 16.

Referring to FIG. 4, the exhaust housing 16 also has an exhaust gas passage 112 which runs from an opening 116 in the top face of the exhaust housing to an opening 118 in the bottom face of the exhaust housing. The opening 116 in the top face of the exhaust housing is in fluid communication with an exhaust port (not shown) of the engine. The opening 118 in the bottom face of the exhaust housing is aligned with the opening 46 (see FIG. 3) in the top face of the inlet/gear housing 18. Consequently, the exhaust gas passage 112 is in fluid communication with the exhaust gas passage of the inlet/gear housing 18. The latter is in turn in fluid communication with the exhaust gas passages 54 on opposing sides of the outlet housing 20. Thus exhaust gases from the engine flow through the connected exhaust gas passages and out the outlets 56 on the outlet housing 20. When the boat is in the water, the outlets 56 are below the waterline.

The exhaust housing 16 also has a vertical water passage 136 for providing cooling water to the engine. The bottom of the water passage 136 is in flow communication with an opening 138 in the stator housing 20. Cooling water is forced upward from the water passage in stator housing 20 by the impeller 80 in a well-known manner.

After the assembled pump unit 100 has been attached to the exhaust housing 16, the entire assembly can be mounted to the hull transom of a boat. First, a thrust bracket 120 is bolted on the back of the transom 12. The thrust bracket 120 comprises a flat mounting plate 122 which lies flat against the transom and a pair of side thrust walls 124 which are generally parallel to each other and perpendicular to the mounting plate 122. The engine housing 16 has a pair of recesses 126 on opposing sides (only one of which is visible in FIG. 3). The side thrust walls 124 fit in the corresponding recesses 126. The distance separating the opposing surfaces of the side thrust walls 124 is only slightly greater than the width of the exhaust housing 16 as measured across the recessed front portion.

After the thrust bracket 120 has been mounted to the transom 12, a pair of mounting brackets 128 (only one of which is shown in FIG. 3) are bolted to the inner face of the upper portion of the hull transom 12, as best seen in FIG. 4. Each mounting bracket 128 comprises a lower portion with holes for bolts and an upper portion with a transverse hole 132 for receiving a respective end of a tilt pivot tube or rod 130. The mounting brackets 128 are positioned so that the upper portions protrude above the top edge of the hull transom 12, with the transverse holes 132 being coaxial. The exhaust housing 16 is positioned so that the holes 134 in support arms 30 are aligned with the transverse holes 132 in the mounting brackets 128. The tilt pivot tube 130 is then passed through aligned holes 132 and 134 and fastened in place by means of threaded nuts (not shown).

After the exhaust housing with attached pump unit has been mounted to the hull, the engine can be lowered into place atop the exhaust housing and then bolted in place. The engine crankshaft is coupled to the drive shaft 64 and the engine exhaust port is aligned with the opening 116 of the exhaust gas passage 112.

In accordance with the arrangement shown in FIG. 4, the entire water jet propulsion unit, when not latched in place, can be swiveled upward about the axis of the tilt pivot tube 130. In the down position, the water jet propulsion unit is laterally restrained by the side thrust walls 124 of the thrust bracket 120.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "duct" means a fluid flow passage having an inlet and an outlet, the duct being formed by a single housing or a multiplicity of housings connected in series.

What is claimed is:

1. A jet-powered boat comprising a hull having a stern and a bottom, and an outboard water jet propulsion system mounted to said hull, wherein said outboard water jet propulsion system comprises:

an engine;

a vertical drive haft powered by said engine;

a horizontal impeller shaft with an impeller mounted thereon;

a gear assembly for coupling said horizontal impeller shaft to said vertical drive shaft;

an inlet housing comprising a planar top face having an exhaust gas inlet and an opening penetrated by said vertical drive shaft, a chamber for housing said gear assembly, a rear face having an exhaust gas outlet, a passageway connecting said exhaust gas inlet with said exhaust gas outlet, and a water tunnel having a water inlet formed in a bottom of said inlet housing and a water outlet formed in said rear face of said inlet housing, said water tunnel and said chamber being separated by a wall that is penetrated by said horizontal impeller shaft; and an exhaust housing pivotably mounted to said hull and supporting said engine, said exhaust housing comprising a top face and a planar bottom face, said bottom face of said exhaust housing sitting on top of said top face of said inlet housing, a vertical passage for said vertical drive shaft, an exhaust gas passage that runs from an opening in said top face of said exhaust housing to an opening in said bottom face of said exhaust housing, said opening in said bottom face of said exhaust housing overlying said exhaust gas inlet in said inlet housing.

2. The boat as recited in claim 1, wherein said outboard water jet propulsion system further comprises an outlet housing attached to said rear face of said inlet housing, said outlet housing comprising a duct outlet in flow communication with said water tunnel and an exhaust gas passage in fluid communication with said exhaust gas passage of said inlet housing.

3. The boat as recited in claim 2, wherein said outlet housing comprises a stator hub and a plurality of stator vanes, said impeller shaft being rotatably supported by a bearing housed within said stator hub.

4. The boat as recited in claim 1, wherein said gear assembly is fastened to said inlet housing.

5. The boat as recited in claim 1, further comprising a thrust bracket arranged between said water jet propulsion system and said stem of said hull, said thrust bracket comprising a flat mounting plate that lies flat against said stem and a pair of side thrust walls that are generally perpendicular to said mounting plate.

6. The boat as recited in claim 3, wherein said exhaust housing comprises a pair of recesses on opposing sides, said side thrust wall of said thrust bracket fitting in said respective recesses in said exhaust housing.

7. The boat as recited in claim 1, further comprising a tilt pivot tub, wherein said exhaust housing comprises a pair of mounting brackets adapted for coupling with said tilt pivot tube, whereby said water jet propulsion system is pivotable relative to said hull about an axis of said tilt pivot tube.

8. The boat as recited in claim 3, wherein said outlet housing has a engine coolant opening located opposite and radially outward of said impeller, and said exhaust housing comprises a vertical water passage for providing cooling water to said engine, said vertical water passage having an inlet overlying said engine coolant opening in said outlet housing.

9. The boat as recited in claim 1, further comprising a bearing assembly rotatably supporting said vertical drive shaft, wherein said bearing assembly is seated in said opening of and fastened to said inlet housing.

10. An outboard water jet propulsion system comprising:

an engine;

an impeller;

a drive train for coupling said impeller to said engine;

an inlet housing comprising a top face having an exhaust gas inlet and an opening penetrated by a first portion of said drive train, a chamber for housing a second portion of said drive train, a rear face having an exhaust gas outlet, a passageway connecting said exhaust gas inlet with said exhaust gas outlet, and a water tunnel having a water inlet formed in a bottom of said inlet housing and a water outlet formed in said rear face of said inlet housing, said water tunnel and said chamber being separated by a wall that is penetrated by a third portion of said drive train;

an outlet housing for housing said impeller and a fourth portion of said drive train, said outlet housing comprising a duct having a water inlet in flow communication with said water tunnel and a water discharge outlet; and an exhaust housing comprising a top face supporting said engine and a bottom face that sits on top of said top face of said inlet housing, a vertical passage for a fifth portion of said drive train, and an exhaust gas passage that runs from an opening in said top face of said exhaust housing to an opening in said bottom face of said exhaust housing, said opening in said bottom face of said exhaust housing overlying said exhaust gas inlet in said inlet housing.

11. The system as recited in claim 10, wherein said outlet housing comprises an exhaust gas inlet in flow communication with said exhaust gas outlet of said inlet housing.

12. The system as recited in claim 10, wherein said bottom face of said exhaust housing and said top face of said inlet housing a each generally planar.

13. The system as recited in claim 10, further comprising a plurality of fasteners whereby said inlet housing is fastened to said exhaust housing.

14. A jet-powered boat comprising a hull having a stern and a bottom, an outboard water jet propulsion system mounted to said hull, wherein said outboard water jet propulsion system comprises:

an engine;

an exhaust housing pivotably mounted to said hull and supporting said engine, said exhaust housing having an exhaust gas passage; a thrust bracket arranged between said water jet propulsion system and said stem of said hull and comprising side wails arranged to receive the exhaust housing therein and prevent lateral rotation of the exhaust housing when the exhaust housing is situated therein;

an axial-flow pump unit attached to said exhaust housing, said axial-flow pump unit comprising a water duct, an impeller mounted to a generally horizontal impeller shaft and rotatable inside said water duct, and an exhaust gas passage in fluid communication with said exhaust gas passage of said exhaust housing;

a drive train for coupling said engine to said impeller shaft for driving said impeller shaft to rotate during engine operation; and a tilt pivot tube, wherein said exhaust housing comprises a pair of mounting brackets adapted for coupling with said tilt pivot tube.

15. A jet-powered boat comprising a hull having a stern and a bottom, an outboard water jet propulsion system mounted to said hull, wherein said outboard water jet propulsion system comprises:

an engine;

an exhaust housing pivotably mounted to said hull and supporting said engine, said exhaust housing having an exhaust gas passage; a thrust bracket arranged between said water jet propulsion system and said stern of said hull and comprising side walls arranged to receive the exhaust housing therein and prevent lateral rotation of the exhaust housing when the exhaust housing is situated therein;

an axial-flow pump unit attached to said exhaust housing, said axial-flow pump unit comprising a water duct, an impeller mounted to a generally horizontal impeller shaft and rotatable inside said water duct, and an exhaust gas passage in fluid communication with said exhaust gas passage of said exhaust housing;

a drive train for coupling said engine to said impeller shaft for driving said impeller shaft to rotate during engine operation;

wherein said water duct has a generally horizontal inlet at a depth not lower than a lowest point of said hull bottom.

* * * * *